US007142165B2

(12) United States Patent
Sanchez et al.

(10) Patent No.: US 7,142,165 B2
(45) Date of Patent: Nov. 28, 2006

(54) WAVEGUIDE AND SLOTTED ANTENNA ARRAY WITH MOVEABLE ROWS OF SPACED POSTS

(75) Inventors: Francisco Javier Vazquez Sanchez, London (GB); Robert A Pearson, Surrey (GB)

(73) Assignee: ERA Patents Limited, Surrey (GB)

( * ) Notice: Subject to any disclaimer, the term of this patent is extended or adjusted under 35 U.S.C. 154(b) by 118 days.

(21) Appl. No.: 10/502,858

(22) PCT Filed: Jan. 23, 2003

(86) PCT No.: PCT/EP03/01463

§ 371 (c)(1),
(2), (4) Date: Aug. 16, 2004

(87) PCT Pub. No.: WO03/065497

PCT Pub. Date: Aug. 7, 2003

(65) Prior Publication Data

US 2005/0128028 A1 Jun. 16, 2005

(30) Foreign Application Priority Data

Jan. 29, 2002 (EP) ..... 02250615

(51) Int. Cl.
*H01P 1/18* (2006.01)
*H01Q 13/20* (2006.01)

(52) U.S. Cl. ..... 343/771; 333/157; 333/248

(58) Field of Classification Search ..... 333/238, 333/239, 248, 157, 159; 343/771

See application file for complete search history.

(56) References Cited

U.S. PATENT DOCUMENTS

| | | | | |
|---|---|---|---|---|
| 3,789,330 | A | 1/1974 | Dixon et al. | |
| 5,504,466 | A | 4/1996 | Chan-Son-Lint et al. | 333/159 |
| 5,940,030 | A | 8/1999 | Hampel et al. | 342/372 |
| 6,518,864 | B1 * | 2/2003 | Ito et al. | 333/238 |

FOREIGN PATENT DOCUMENTS

EP 1 033 773 9/2000

(Continued)

OTHER PUBLICATIONS

Uchimira, H., *Development of the "Laminated Waveguide"*, 1998 IEEE MTT-S International Microwave Symposium Digest, Baltimore, MD, Jun. 7-12, 1998.

(Continued)

*Primary Examiner*—Benny T. Lee
(74) *Attorney, Agent, or Firm*—Baker & Daniels

(57) ABSTRACT

A waveguide structure including two parallels electrically conducting ground planes (1,2), each of which includes at least one row of spaced apart electrically conducting posts (3). The rows of posts are arranged substantially parallel to one another and the space bounded by the plates and posts defines a guided wave region (4) along which electromagnetic radiation may propagate. The posts are connected to only one of the planes so that there is no physical connection between the two ground planes (1,2). Actuating means may be connected to one or both of the ground planes to cause relative movement there between to thereby alter the electrical response of the waveguide. The direction of the relative movement may such that the distance between the rows of posts (3) is changed and/or the distance between the ground planes (1,2) is changed. Various device may utilize the described waveguide construction, including reconfigurable waveguide filters and antenna structures e.g. slotted waveguide arrays.

19 Claims, 4 Drawing Sheets

FOREIGN PATENT DOCUMENTS

| | | |
|---|---|---|
| EP | 1 148 583 | 10/2001 |
| EP | 1 235 296 | 8/2002 |
| EP | 0 984 509 | 5/2004 |
| FR | 2 581 255 | 10/1986 |
| GB | 1 377 742 | 12/1974 |
| JP | 06-053711 | 2/1994 |

OTHER PUBLICATIONS

Hirokawa, J., et al.: *40GHz Parallel Plate Slot Array Fed by Single-Layer Waveguide Consisting of Posts in a Dielectric Substrate*, Antennas and Propogation Society International Symposium, 1998. IEEE Atlanta, GA, Jun. 21-26, 1998.

* cited by examiner

WAVEGUIDE AND SLOTTED ANTENNA ARRAY WITH MOVEABLE ROWS OF SPACED POSTS

INTRODUCTION

This invention relates to waveguides and in particular, though not solely, to waveguides which include mechanically movable parts to alter their electrical characteristics.

Transmission lines, and in particular waveguides, have many applications in the microwave field including radiofrequency beamformers, filters, rotary joints and phase shifters. The use of low cost manufacturing techniques, including the use of metallized plastics for the implementation of multilevel beamforming architectures have been described in, for example, EP-A-1148583. Such structures generally require that the metallized plastics waveguide parts are split, ideally along the center of the broadwall (E-plane) in the case of rectangular waveguides. However, it is very well known that splits in the narrow walls of rectangular waveguides lead to high attenuation due to the large currents flowing across the split discontinuity.

Such split constructions allow multilevel beamformers to be realized by fabrication of individual parts that are subsequently bonded together in such a way that the impact of the joint is minimized. In the case of metallic waveguides this sometimes involves dip brazing, or in the case of metallized plastics, limits the joint's position along the center of the broadwall, in the case of rectangular waveguides. Such restrictions do not apply to dip brazed components, however these are not well suited to volume manufacture.

Waveguide devices with moving parts (for example, rotary joints for radar antennas, phased arrays, radio frequency switches, reconfigurable filters and phase shifters) are difficult to implement since waveguides are usually based on closed metal cavities. There is therefore a constraint imposed on the implementation of mechanically actuated phase shifting devices based on waveguides because metal or dielectric parts, including the actuator, have to be mounted inside the waveguide thereby introducing losses and distortion and requiring a relatively complex design. An example of a mechanically actuated phase shifting device is disclosed in FR-A-2581255.

Controlled phase shifting using electronic components such as ferrite phase shifters and electronic switches (i.e. PIN diodes) have been developed over the last 30 years and these have found extensive application in radar and radio location systems, as a way of steering or reconfiguring antenna radiation patterns.

A major obstacle to the use of electrically controlled phase shifters in many scanning beam antenna applications is the high cost and the large number of phase shifting devices required for beam steering. The production cost of electronically scanned antennas is still very high, even when significant volumes are produced. In addition, electronic phase shifters introduce additional losses and a considerable DC power consumption that limits their application for systems that use batteries for power supply such as mobile/personal communication devices.

Mechanical phase shifters are an attractive low cost solution for antenna applications that do not require a fast (in the order of milliseconds) scan of the beam. Mobile satellite communication links on stable platforms like cars, ships and commercial aircraft require scan rates in the order of only tenths of a second, which can be achieved by mechanical means.

A number of mechanical phase shifters have been developed in recent years. Most of them, such as EP-A-1033773 and U.S. Pat. No. 5,504,466 are based on the variation of the physical dimensions (including length) of a waveguide or transmission line. Others, such as EP-A-0984509 and U.S. Pat. No. 5,940,030, are based on movable dielectric elements inside or close to transmission lines. Another approach is based on a periodic spatial loading of transmission lines and is described in EP-A-1235296 wherein the amount of electrical loading on the line caused by the periodic structure is controlled using a moving metal plate in the vicinity of the periodic structure on the line.

Most of these devices are simple to manufacture, have reasonably low losses and are easily implemented at a low frequency band (typically L-Band and S-band) for coaxial lines and for other TEM lines such as stripline and microstrip. The implementation of these electromechanical techniques for high frequencies (typically Ku-Band, Ka-Band and millimeter wavelengths) in waveguide structures is much more difficult; in particular because high frequency waveguides are formed by a solid metal enclosure which becomes lossy when filled with dielectrics.

One possible way to realize an electro-mechanical phase shifter is to use a secondary movable wall inside a metal waveguide as disclosed in U.S. Pat. No. 3,789,330, however, this approach is difficult to realize since the secondary wall cannot be connected to the waveguide if it is to be freely movable. This can result in the generation of spurious and additional waveguide modes which are very difficult to control. Another issue is the placement of the control device. If the device is placed inside the waveguide (i.e., a piezoelectric crystal), it can produce severe distortion of the waveguide modes and introduce large losses. If the device is outside the waveguide, such as for example in the above-mentioned FR-A-2581255, the metal enclosure must be perforated to allow access to the moving part thereby introducing additional distortion and losses.

The combination of mechanical antenna rotation with single plane scanning using phase shifters was described in "*An Array-fed Dual Reflector Antennas for Limited Sector Beam Scanning*", R A Pearson, PhD Thesis, University of London, April 1988, in which equi-spaced array of waveguide radiators is filled using flares along the length of the phase scanning plane, the whole structure being rotated to scan the beam in any arbitrary plane. In that implementation, the primary radiating structure was further combined with a dual reflector system to magnify the aperture.

Alternative waveguide configurations using periodic structures known as Photonic Band Gap (PBG) crystals, have been suggested in the last decade (see for example "*Photonic Crystals: Molding the flow of light*", J D Joannopoulos, Princeton University Press, NJ 1995) to simplify the manufacture of dielectric waveguides, especially at the infrared and visible light region of the spectrum. Most of these waveguides are based on fixed periodic distributions of dielectric materials acting as boundaries for the guided electromagnetic wave. Practical applications of these techniques to radio frequencies are much less developed although examples are shown in "*A Novel waveguide using Uniplanar Compact Photonic Bandgap (UC PBG) Structure", IEEE Transactions on Microwave Theory and Techniques*, Vol 47, No. 11, November 1999 and our European Patent Application No. EP01304526.5. Despite its potential, these waveguide configurations using periodic structures do not overcome the manufacturing problems associated with contact between moving waveguide parts and they do not allow moving parts within the structure to implement mechanical phase shifters, rotary joints and other reconfigurable devices for radio circuits.

It is therefore an object of the present invention to provide a waveguide which goes at least some way towards overcoming the above disadvantages or which will at least provide the industry with a useful choice.

SUMMARY OF THE INVENTION

In a first aspect, the invention consists in a waveguide comprising:

a first electrically conductive ground plane, a second electrically conductive ground plane spaced from and parallel to the first ground plane, a first row of electrically conductive spaced posts fixed to and extending substantially perpendicularly from the first ground plane towards but not touching the second ground plane, a second row of electrically conductive spaced posts fixed to and extending substantially perpendicularly from the second ground plane towards but not touching the second ground plane, the volume bounded by the first and second ground planes and the first and second rows of posts defining a guided wave region along which electromagnetic radiation may propagate.

Preferably, the first and second rows of posts are parallel so that the guided wave region has a substantially constant cross-section.

Preferably, the posts of the first and second rows are all of the same length which is less than the distance between the first and second ground planes.

Preferably, the distance between the first and second ground planes is about half a wavelength at the operating frequency and the posts have a length of about one quarter of a wavelength.

Preferably, the width of the posts is about ⅓ of the post height.

Preferably, one of the first or second ground planes includes a continuous step, between and parallel to the first and second rows of posts.

Preferably, actuating means are connected to one or both of the ground planes to provide relative movement between the rows of posts by moving the first and second ground planes relative to each other to thereby adjust the propagation constant of the guided electromagnetic wave.

Preferably the distance between the first and second rows of posts is changed but the distance between the ground planes is unchanged by the relative movement.

Alternatively, the distance between the ground planes is changed but the distance between the first and second rows of posts is unchanged by the relative movement.

Preferably, the first ground plane is provided with a plurality of parallel spaced apart first rows of posts and the second ground plane is provided with a plurality of parallel spaced apart second rows of posts.

In a second aspect, the invention consists in a passive reconfigurable filter including a waveguide according to the first aspect, and actuating means connected to one or both of the ground planes to provide relative movement between the rows of posts by moving the first and second ground planes relative to each other to thereby adjust the frequency response of the waveguide.

In a third aspect, the invention consists in a phase shifting device including a waveguide according to the first aspect, two transitions connecting fixed solid waveguides at the input and output of the device to the waveguide according to the first aspect, and actuating means to provide relative movement between rows of posts to thereby adjust the propagation constant of the waveguide.

In a fourth aspect, the invention consists in an array of parallel aligned waveguides according to the first aspect, each of the waveguides sharing common first and second ground planes.

In a fifth aspect, the invention consists in a beam scanning antenna array comprising an array of parallel aligned waveguides according to the third aspect, each waveguide having at least one radiating slot, the slots from all of the waveguides provided in only one of the first or second ground planes and each slot aligned with or perpendicular to the propagation direction of the guided wave region, and actuating means connected to one or both of the common ground planes to provide relative movement between the rows of posts by moving the first and second ground planes relative to each other to thereby steer the antenna beam in the elevational plane of the antenna array.

Preferably, rotating means are provided to rotate the scanning antenna array in a plane perpendicular to the elevational plane.

Preferably, a periodic structure is also provided within each waveguide to delay the guided electromagnetic wave and thereby extend the angular scanning range of the antenna beam.

Preferably, an array of radial horns or dielectric lenses are also provided, each radial horn or dielectric lense juxtaposed adjacent the at least one radiating slot of respective waveguides.

Preferably, at least one of the top or bottom ground planes is formed from a dielectric plate, the posts formed integrally therewith, the posts and only the surface of the dielectric plate facing the other ground plane coated in a conductive material, wherein the radiating slots are formed in the metal coating, and wherein the dielectric lenses are integrally formed with the dielectric plate.

Accordingly, the waveguide may have two parallel metallic plates and a periodic structure of metal posts connected to one or other of the plates, without simultaneous physical contact to both. At some frequencies, the periodic structure creates a virtual short circuit between the parallel plates, preventing the leakage of energy from the waveguide. Structures including waveguides, beamformers and rotary or rotating joints can be built utilizing the invention.

BRIEF DESCRIPTION OF THE DRAWINGS

Particular examples of the invention will now be described with reference to the accompanying drawings, in which.

DETAIL DESCRIPTION OF PREFERRED EMBODIMENTS

Figure 1:
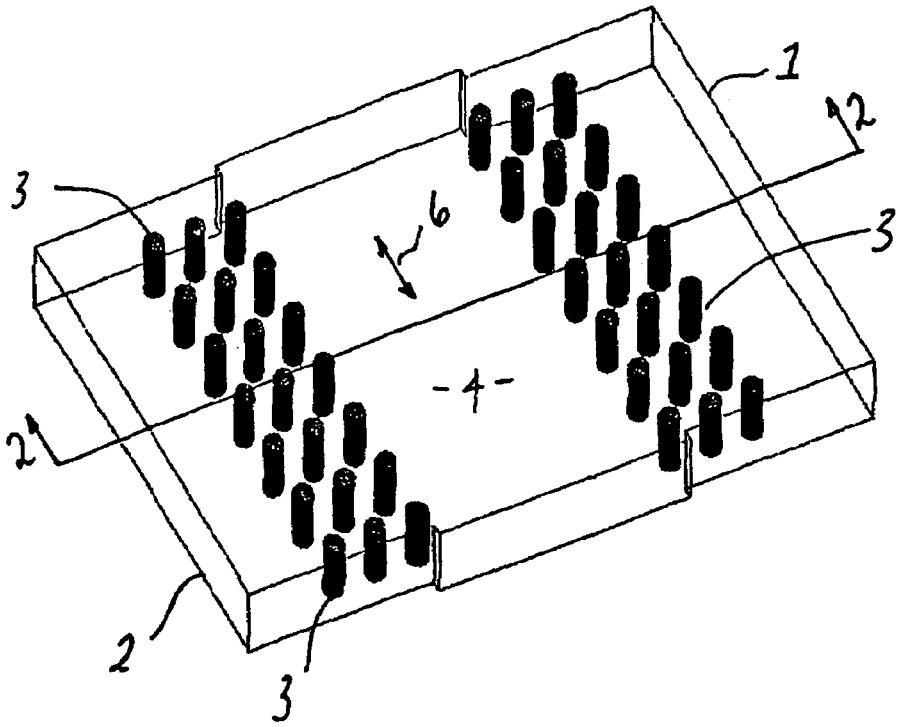
FIG. 1 is a perspective view of a rectangular waveguide structure in accordance with the present invention.
Figure 2:
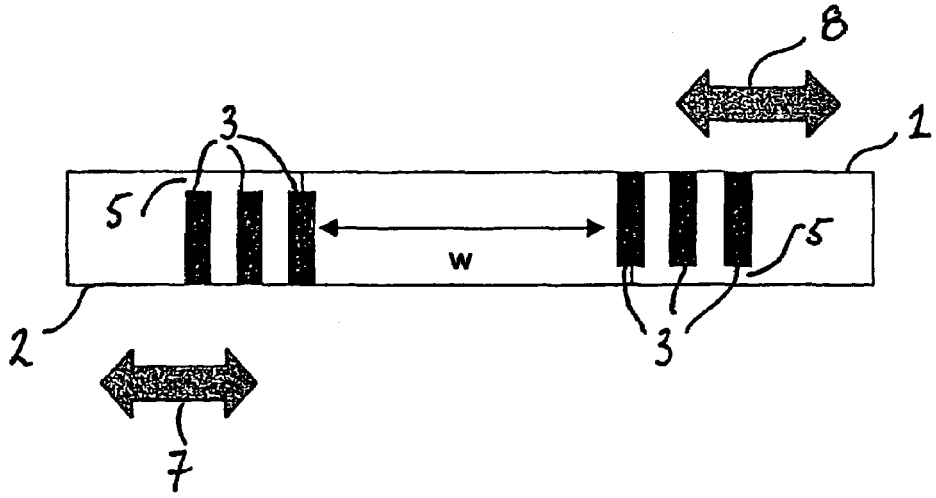
FIG. 2 is a cross-sectional view through the line 2—2 of the rectangular waveguide of FIG. 1.

With reference to the drawings and in particular FIGS. 1 and 2, a waveguide is shown which includes two electrically conductive plates forming top 1 and bottom 2 ground planes. The ground planes 1,2 are arranged substantially parallel to each other and separated by a series of conductive posts 3. The conductive posts 3 are arranged substantially perpendicular to both of the ground planes 1,2. Ground planes 1,2 and posts 3 may, for example, be metallic or may be made from a metallized plastics material.

The posts 3 are typically distributed periodically in straight lines in one or more rows on either side of a central, guided wave region 4 which is free of posts and in which electromagnetic energy is guided and confined. The spacing of adjacent posts in a row is not necessarily constant, the distance between adjacent parallel rows is not necessarily the same and the spacing of posts in different rows is also not necessarily the same. However, it is preferred that the posts are uniformly spaced in each row and that the spacing is constant in all rows. Preferably the spacing between adjacent rows is about $\lambda/10$ and the spacing between posts in the same row is less than about $\lambda/4$ where $\lambda$ is the wavelength at the central frequency of the operating band.

Each conductive post 3 is connected at only one of its ends to either one of the ground planes, leaving a gap 5 (FIG. 2) between each post 3 and the opposing ground plane 1 or 2. The waveguide construction may therefore be considered "contact-less" because the top 1 and bottom 2 ground planes are effectively not connected by conventional side walls. The posts 3 may be bonded or welded to their associated ground plane or may be integral therewith.

Each of the posts 3 on one side of the guided wave region 4 are connected to the top ground plane 1 while each of the posts 3 on the other side of the guided wave region 4 are connected to the bottom ground plane 2. As the posts 3 are in straight rows and are perpendicular to the ground planes 1,2, the shape of the central guided wave region 4 FIG. 1) is substantially rectangular as shown in FIG. 1 with a width w as shown in FIG. 2. In the working frequency band a virtual short circuit (zero impedance) is created between the top 1 and bottom 2 ground planes by resonance of the posts associated inductance and capacitance. A guided wave will therefore propagate in the guided wave region 4 in the direction parallel to the rows of posts 3 as shown by arrow 6 in FIG. 1.

In the operating frequency band, the separation between parallel plates is less than half a wavelength, more preferably between about $0.3\lambda$ and about $0.4\lambda$. The height of the posts 3 is of the order of one quarter of the wavelength at the central frequency of the operating band and more preferably between about $0.2\lambda$ and about $0.3\lambda$, but the post height also depends on the post diameter and the separation between them due to mutual coupling between adjacent posts. The cross-sectional shape of the posts may be, for example, rectangular (including square), circular or elliptical and may be selected based upon the manufacturing procedure used. Other cross-sectional shapes are also possible if they are convenient for manufacturing and so long as they have sufficient associated inductance and capacitance for resonance to occur within a useful frequency range. The diameter of the posts is much smaller than the height and may, for example, be less than or equal to about ⅓ of the post height.

As previously mentioned, the conductive posts 3 create a virtual conductive wall or virtual short circuit in the operating frequency band. In fact, the posts 3 behave as an equivalent resonant circuit in parallel with the ground plane 1,2. A row of posts 3 produces a low impedance boundary, similar to a metallic wall connecting the top 1 and bottom 2 planes thereby effectively simulating the function of planar side walls in conventional rectangular waveguides. The combination of several rows of posts 3 can be used to extend the bandwidth of the waveguide as compared to the case of the virtual walls formed by single rows of posts 3.

For a rectangular shaped contact-less waveguide, the fundamental electromagnetic mode inside the waveguide is very similar (outside the post areas) to the TE.sub.10 mode of a conventional rectangular waveguide having an equivalent width approximately equal (typically 1–2% less) to the width w (FIG. 2) of the central guided wave region 4 of the contact-less waveguide.

As the top 1 and bottom 2 ground planes are not physically connected, it is possible to displace one with respect to the other by moving one or both of the ground planes 1,2 (and thereby the rows of posts 3) in the direction of arrows 7 and 8 in FIG. 2. This relative movement alters the width of the guided wave region 4. This produces a modification to the waveguide impedance and wave propagation constant and therefore can be used to reconfigure the electric performance of a waveguide or a device or circuit based on the waveguide according to the present invention.

The dimensions of the wave guide can thus be changed, without the use of additional internal dielectric or metallic parts, which could interfere with the fields inside the waveguide, to create a phase change along the waveguide. The waveguide according to the invention is therefore capable of acting as a phase shifter. If one of the ground planes 1,2 is displaced laterally with respect to the other, the virtual short circuit wall is also displaced, keeping the basic rectangular shape of the waveguide unchanged. The phase of the wave at the end of the waveguide is modified since the propagation constant of the wave inside the waveguide is directly related to the width w of the waveguide. The propagation constant $\gamma$ of the fundamental mode of the waveguide can be calculated using the formula:

$$\gamma = \sqrt{k^2 - \left(\frac{\phi_{11}}{w}\right)^2}$$

where k is a constant, w is the width of the channel between the inner row of posts 3 and $\varnothing_{11}$, is the phase in radians of the reflection coefficient of the posts 3 to an incident TEM parallel plane wave. In general, $\varnothing_{11}$ depends on the frequency and the angle of incidence, which is directly related to the propagation constant $\gamma$.

Figure 3:
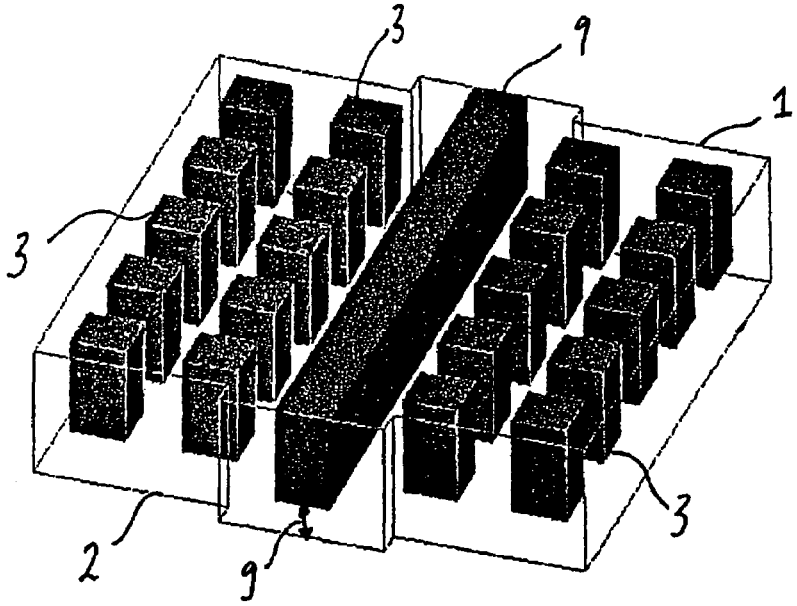
FIG. 3 is a perspective view of a ridge waveguide made in accordance with the present invention.

Relative vertical displacements of the ground planes 1,2 can also be used to introduce phase shift for a contact-less version of the waveguide and in particular to a contact-less version of a ridge waveguide as shown in FIG. 3. In FIG. 3, the posts 3 (shown having square cross-sections in this example) and a conductive ridge 9, which extends parallel to the rows of posts, could all be attached to the same ground plane 1,2. Alternatively, the posts 3 on one side of the central guided wave region and the ridge 9 could be connected to the same ground plane 1,2 and the posts 3 on the other side of the central guided wave region could be connected to the other ground plane 2,1.

The distance between ridge 9 which is attached to top ground plane 1 in the example shown and the opposing bottom ground plane 2 greatly influences the propagation constant. In this case, the maximum allowable relative displacement between the ground planes is limited by the allowable gap g between the posts 3 and the respective opposing plates 1,2. It will be appreciated that if the gap g exceeds a threshold value then the posts 3 may stop acting as virtual walls and the response of the waveguide will be affected.

Well known linear transducers or electric motors could be suitably connected to the outer surface of one or both of the ground planes 1,2 in order to accomplish the required relative movement in the lateral or vertical directions. Lateral and vertical displacement could be incorporated in the design of a single waveguide.

Contact-less waveguides can be used to implement power dividers, filters, couplers and other passive devices typically used in radio or microwave networks. The electrical characteristics of these devices can also be changed by the relative displacement of the top 1 and bottom 2 ground planes and their associated posts 3.

It is also possible to realized structures that utilize the contact-less aspect of the invention to implement mechanical displacement, for example to steer the beam transmitted and/or received by an integral or separate radiating structure, or as part of a rotary joint, in which the electrically significant parts are physically separated and parts which are not critical electrically are used to realize the mechanical rotation. Reconfigurable waveguide filters can also be implemented using the contact-less waveguide since the width of resonating sections of the waveguide can be changed by lateral displacement thereby affecting the waveguide's frequency response.

It is possible to simultaneously control phase changes in several associated waveguides which share the same ground planes 1,2. The waveguides may have different widths w and operate at different frequencies, but they must have the same height since the separation between ground planes 1,2 is the same for all of them.

Contact-less waveguides according to this invention can also radiate or absorb electromagnetic waves and therefore act as antennae by controlled leakage or absorption of energy from apertures in one or both ground planes 1,2. The radiation/absorption from these apertures depends on their relative position and orientation in the ground planes, in a similar way to the apertures in conventional rectangular waveguides.

Due to the similarity between the fields in the present contact-less and conventional rectangular waveguides, it is possible to implement contact-less versions of conventional slotted waveguide arrays and of conventional radiators using a longitudinal slot utilizing the waveguide according to this invention.

Figure 4:
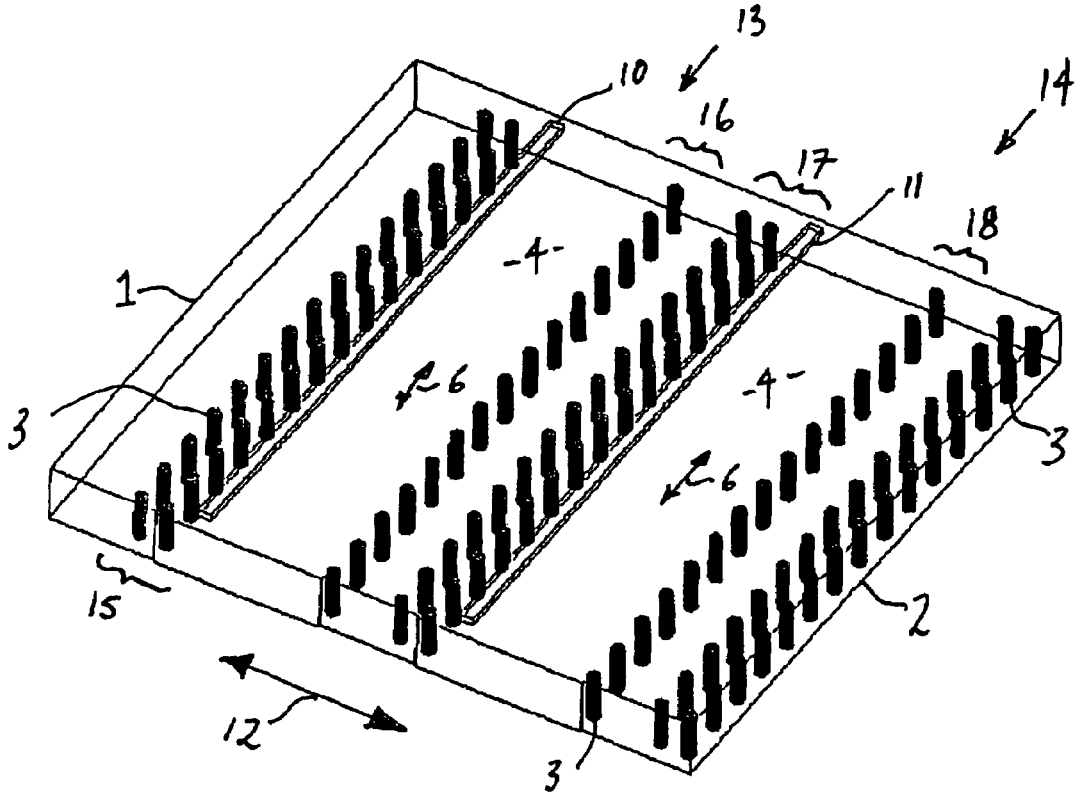
FIG. 4 is a scanning array of radiating slots on waveguides according to the present invention.

FIG. 4 shows an example of a scanning array of radiating slots (two radiating slots 10,11 in the top ground plane 1 are shown) on contact-less waveguides according to this invention. The propagation constant of slotted waveguides according to this invention can be controlled simultaneously by a single lateral displacement between common ground planes 1,2 in the direction of arrow 12. In FIG. 4, only two waveguides 13,14 are shown, both sharing common top 1 and bottom 2 ground planes with respective virtual side walls formed by rows of conductive posts 3. The rows of posts 15 and 16 form virtual side walls for waveguide 13 while rows of posts 17 and 18 form virtual side walls for waveguide 14. The posts 3 in rows 15 and 17 should be connected to only one, but the same, ground plane 1 or 2 while the posts in rows 16 and 18 should be connected to only one, but not the other, ground plane 2 or 1. A guided wave will propagate in the guided wave region 4 in the direction as shown by arrows 6.

In order to improve the radiation efficiency of the slots, an array of radial horns or an array of dielectric lenses may be positioned adjacent the top ground plane 1, ach of the horns or lenses aligned with a respective radiating slot. In the case of dielectric lenses being added, the array of lenses, slots and posts may be constructed integrally with each other and one of the ground planes. This may be accomplished by constructing one of the ground planes (for example, top ground plane 1) using metallized plastics wherein a plate of plastic material is used to form a single solid dielectric lens array layer which is coated with metal on one side (the other, outer side, need not be metallized) to form the top ground plane which faces the bottom ground plane 2. Slots 10,11 etc are etched in the metal layer and posts are molded or formed integrally with the plastic plate, on the same side as the etched metallized ground plane, and also metallized. This construction provides a robust mechanical structure. The slots 10, 11 may have a slot width which may be varied periodically. The slots 10, 11 may also be covered with a thin layer of dielectric material to prevent the radiation of slotline waves.

Each radial horn aperture or dielectric lens structure may be provided with an integral polarizing structure to, for example, generate circularly polarized waves on transmit or to convert a circularly polarized wave to linear polarization to thereby provide efficient coupling on receive.

The direction of the radiation beam generated (or received) by these arrays is directly related to the propagation constant inside the waveguide. As a result, the antenna beam is steered in the elevation plane by the relative displacement of the ground planes 1,2. At microwave frequencies (Ku-Band and Ka-Band) the lateral displacement required to scan a beam from 30.degree. to 60.degree. is in the order of several millimeters, and can be realized by means of, for example, conventional low cost electrical motors.

Corrugations or a similar periodic conductive or dielectric structure may either be positioned inside the waveguides or may form an integral part of the inner conducting surface of the upper 1 or lower ground plane. The periodic structure delays or slows down the electromagnetic wave within the wave guide and, therefore, in conjunction with the waveguide according to his invention, extends the angular scanning range of the antenna scanning beam.

Antenna structures particularly suited to circular polarization can therefore be made using this invention, with beam scanning along the length of the wave guide, to thereby realize full beam scanning as part of a low profile structure by rotating the whole structure orthogonal to the plane of the antenna aperture.

Figure 6:
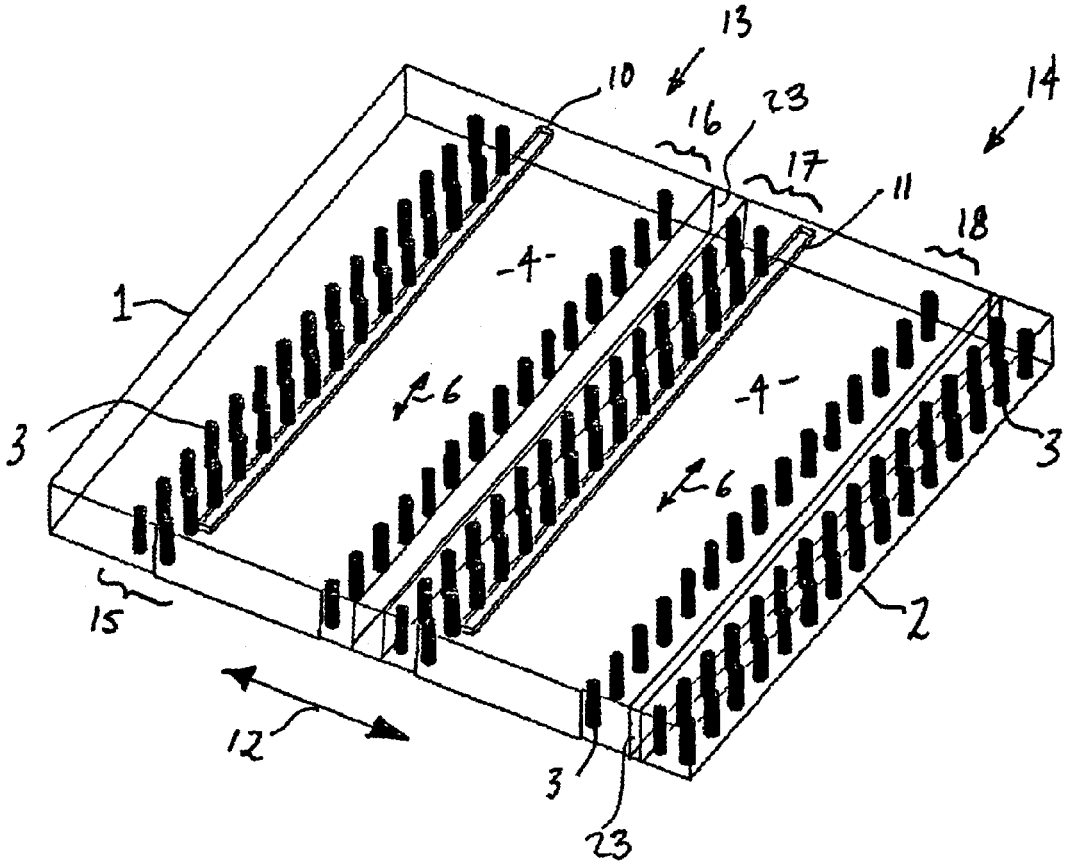
FIG. 6 is a perspective view of a scanning array of radiating slots on waveguides according to the present invention having mobile dielectric supports.

With reference to FIG. 6, the scanning array may further be provided with mobile dielectric supports 23 between the first and second ground planes 1, 2 within cavities formed by rows of posts 15, 16, 17, 18 in order to ensure the mechanical stability of the array without hampering the movement of the ground planes 1,2. The elements denoted by the remaining reference numerals are identical to those of FIG. 4 in that FIG. 6 is a modification of the embodiment of FIG. 4.

Figure 5:
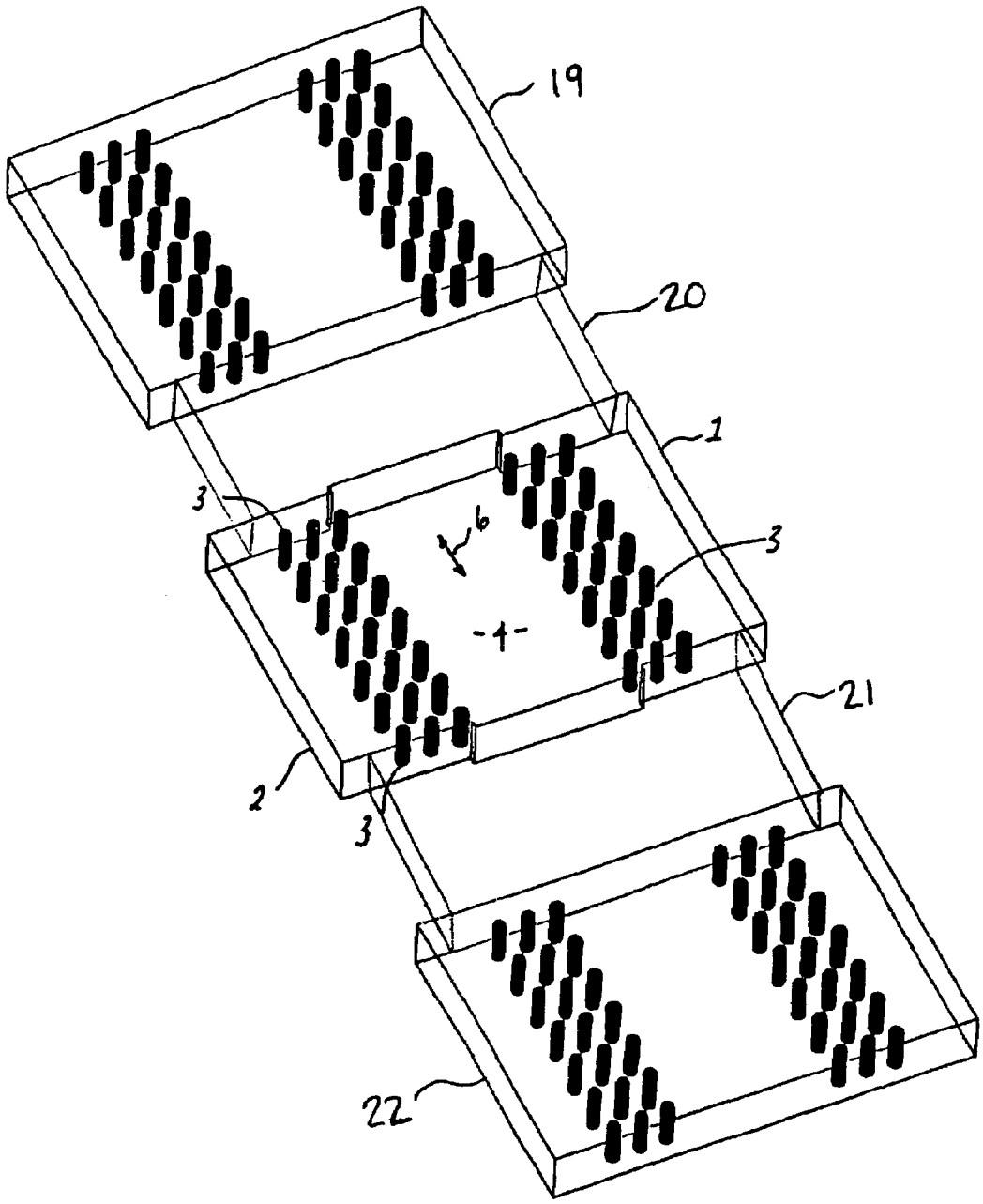
FIG. 5 is a perspective view of a phase shifting device including a waveguide in accordance with the present invention, two transitions and two fixed solid waveguides.

FIG. 5 shows an example of a phase shifting device including two fixed, solid waveguides 19, 22 and a waveguide in accordance with the present invention. Reference numeral 4 represents the guided wave region and reference numeral 6 represents the direction of the guided propagated wave. wave. One of the fixed, solid waveguides 19 is disposed at the input of the phase shifting device and is connected to the waveguide via a transition 20. The other of the fixed, solid waveguides 22 is disposed at the output of the phase shifting device and is connected to the waveguide via another transition 21. Actuating means may be connected to one or both of the ground planes 1, 2 of the waveguide to provide relative movement between rows of posts 3 to thereby adjust the propagation constant of the waveguide. Accordingly, controlled phase shifting may be performed.

The invention claimed is:

1. A waveguide comprising:

a first electrically conductive ground plane, a second electrically conductive ground plane spaced from and parallel to the first ground plane, a first row of electrically conductive spaced posts fixed to and extending substantially perpendicularly from the first ground plane towards but not touching the second ground plane, and a second row of electrically conductive spaced posts fixed to and extending substantially perpendicularly from the second ground plane towards but not touching the first ground plane, the volume bounded by the first and second ground planes and the first and second rows of posts defining a guided wave region along which electromagnetic radiation may propagate;

wherein the distance between the first and second ground planes is about half a wavelength at the operating frequency and the posts have a length of about one quarter of a wavelength.

2. The waveguide of claim 1, wherein the first and second rows of posts are parallel to each other so that the guided wave region has a substantially constant cross-section.

3. The waveguide of claim 1, wherein the posts of the first and second rows are all of the same length which is less than the distance between the first and second ground planes.

4. The waveguide according to claim 1 wherein the first ground plane is provided with a plurality of parallel spaced apart first rows of posts and the second ground plane is provided with a plurality of parallel spaced apart second rows of posts.

5. The waveguide of claim 1, wherein the width of the posts is about ⅓ of the post height.

6. The waveguide of claim 1, wherein one of the first or second ground planes includes a continuous step, between and parallel to the first and second rows of posts.

7. The waveguide of claim 1, wherein actuating means are connected to one or both of the first and second ground planes to provide relative movement between the first and second rows of posts by moving the first and second ground planes relative to each other to thereby adjust the propagation constant of the guided electromagnetic radiation.

8. The waveguide according to claim 7, wherein the distance between the first and second rows of posts is changed but the distance between the first and second ground planes is unchanged by the relative movement.

9. The waveguide according to claim 7, wherein the distance between the first and second ground planes is changed but the distance between the first and second rows of posts is unchanged by the relative movement.

10. A phase shifting device including a waveguide according to claim 7, and two transitions connecting two solid waveguides to the waveguide, wherein relative movement of the first and second ground planes adjusts the propagation constant of the waveguide.

11. A passive reconfigurable filter including a waveguide according to claim 7, wherein relative movement of the first and second ground planes adjusts the frequency response of the waveguide.

12. An array of parallel aligned waveguides according to claim 1, wherein each of the parallel aligned waveguides share common first and second ground planes.

13. A beam scanning antenna array comprising:

said array of parallel aligned waveguides according to claim 12, each waveguide having at least one radiating slot, the radiating slots from all of the waveguides provided in only one of the first or second ground planes and each radiating slot aligned with or perpendicular to the propagation direction of the guided wave region, and actuating means connected to one or both of the common first and second ground planes to provide relative movement between the first and second rows of posts by moving the first and second ground planes relative to each other to thereby steer the antenna beam in the elevational plane of the antenna array.

14. A beam scanning antenna array as claimed in claim 13, further comprising mobile dielectric supports between the first and second ground planes within cavities formed by the first and second rows of posts in order to ensure the mechanical stability of the array without hampering the movement of the first and second ground planes.

15. A beam scanning antenna array as claimed in claim 13, further comprising rotating means provided to rotate the scanning antenna array in a plane perpendicular to the elevational plane.

16. A beam scanning antenna array as claimed in claim 13 wherein a slot width is defined as the lesser dimension of the at least one radiating slot, the slot width being varied periodically, or wherein the slot is covered with a thin layer of dielectric to prevent the radiation of slotline waves.

17. A beam scanning antenna array as claimed in claim 13, further comprising a periodic structure within each waveguide to delay the guided electromagnetic wave and thereby extend the angular scanning range of the antenna beam.

18. A beam scanning antenna array as claimed in claim 13, further comprising an array of radial horns or dielectric lenses, each radial horn or dielectric lense juxtaposed adjacent the at least one radiating slot of respective waveguides.

19. A beam scanning antenna array as claimed in claim 18, wherein at least one of the first and second ground planes is comprised of a dielectric plate, the posts formed integrally therewith, the posts and only the surface of the dielectric plate facing the other of the first and second ground planes is in a conductive material, wherein the radiating slots are disposed in the metal coating, and wherein the dielectric lenses are integrally formed with the dielectric plate.

* * * * *